United States Patent [19]

Kuebler

[11] Patent Number: 4,768,786

[45] **Date of Patent: * Sep. 6, 1988**

[54] TENNIS RACKET

[76] Inventor: Siegfried Kuebler, Mozartstr. 17, D777 Ueberlingen, Fed. Rep. of Germany

[ * ] Notice: The portion of the term of this patent subsequent to May 12, 2004 has been disclaimed.

[21] Appl. No.: 17,933

[22] Filed: Feb. 24, 1987

Related U.S. Application Data

[63] Continuation-in-part of Ser. No. 698,189, Feb. 4, 1985, Pat. No. 4,664,380.

[30] Foreign Application Priority Data

Oct. 17, 1986 [DE] Fed. Rep. of Germany ..... 3635372

[51] Int. Cl.[4] ..... A63B 49/02

[52] U.S. Cl. ..... 273/73 C; 273/73 G; 273/73 D

[58] Field of Search ..... 273/73 R, 73 C, 73 D, 273/73 F, 73 J, 73 G, 73 H, 73 L, 73 K, 67 B, 326; D21/212

[56] References Cited

U.S. PATENT DOCUMENTS

| | | | |
|---|---|---|---|
| D. 233,355 | 10/1974 | Foley | D21/212 |
| D. 243,467 | 2/1977 | Konvelas | D21/212 |
| 2,171,223 | 8/1939 | Robinson | 273/73 H |
| 3,640,533 | 2/1972 | Davis et al. | 273/73 K X |
| 3,647,211 | 3/1972 | Doessel et al. | 273/73 C |
| 3,809,402 | 5/1974 | Haines et al. | 273/73 C |
| 4,070,020 | 1/1978 | Dano | 273/DIG. 23 X |
| 4,291,574 | 9/1981 | Frolow | 273/73 C |
| 4,293,129 | 10/1981 | Planakis | 273/73 C X |
| 4,322,076 | 3/1982 | Bertram et al. | 273/73 G X |
| 4,438,925 | 3/1984 | Lindstrom | 273/75 |
| 4,440,392 | 4/1984 | Popplewell | 273/DIG. 23 X |

FOREIGN PATENT DOCUMENTS

| | | | |
|---|---|---|---|
| 2228245 | 1/1974 | Fed. Rep. of Germany | 273/73 H |
| 827983 | 5/1938 | France | 273/73 J |
| 962312 | 12/1949 | France | 273/73 K |
| 0085634 | 7/1978 | Japan | 273/73 K |
| 415707 | 8/1934 | United Kingdom | 273/73 J |

*Primary Examiner*—Richard C. Pinkham
*Assistant Examiner*—William E. Stoll
*Attorney, Agent, or Firm*—Bachman & LaPointe

[57] ABSTRACT

A racket, for playing a game using a ball of limited resiliency, such as a tennis racket comprises a racket head frame portion provided with stringing, a handle, and a shaft arrangement connecting the racket head frame portion and the handle. The resonance frequency of the racket head frame portion at least approximately corresponds to the period of time for which a ball is in contact with the strings of the racket when struck thereby, and the natural frequency or oscillation frequency of the racket substantially corresponds to the excitation frequency of the ball. The thickness of the racket frame as measured in a direction normal to the plane of the stringing is greater than the thickness of the handle as measured in a corresponding direction.

13 Claims, 4 Drawing Sheets

FIG-1
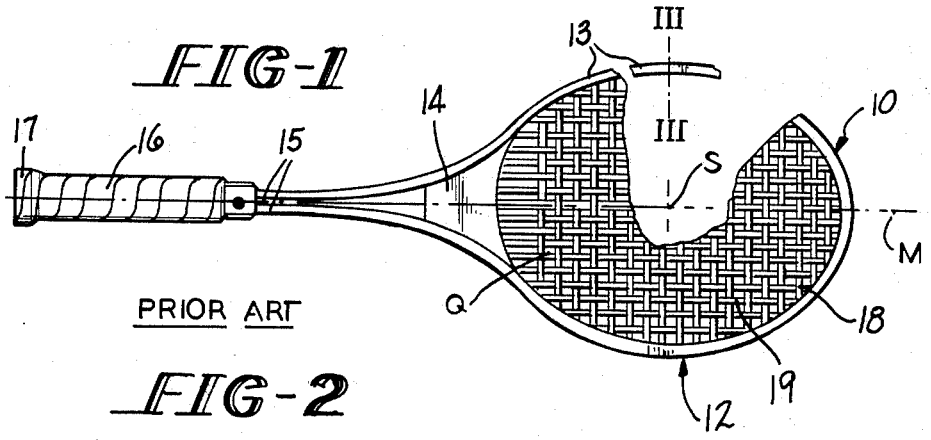
PRIOR ART
FIG-2
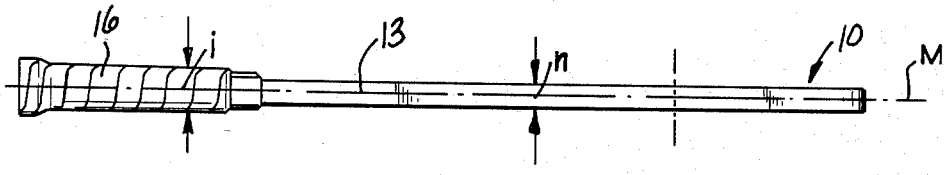
PRIOR ART
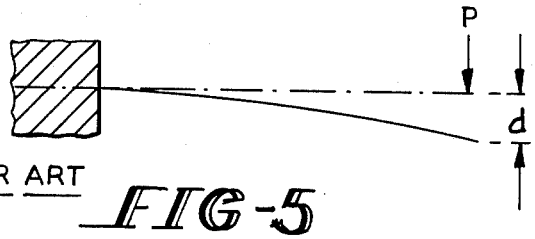
PRIOR ART
FIG-5
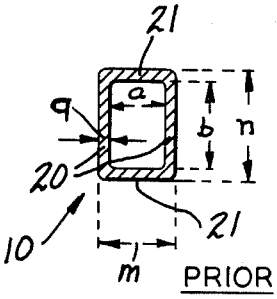
PRIOR ART
FIG-3
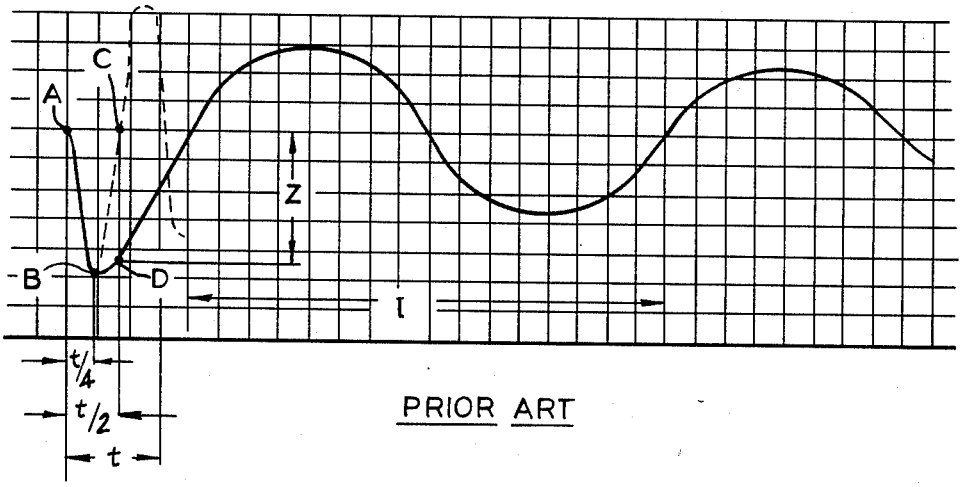
PRIOR ART
FIG-4

FIG-6
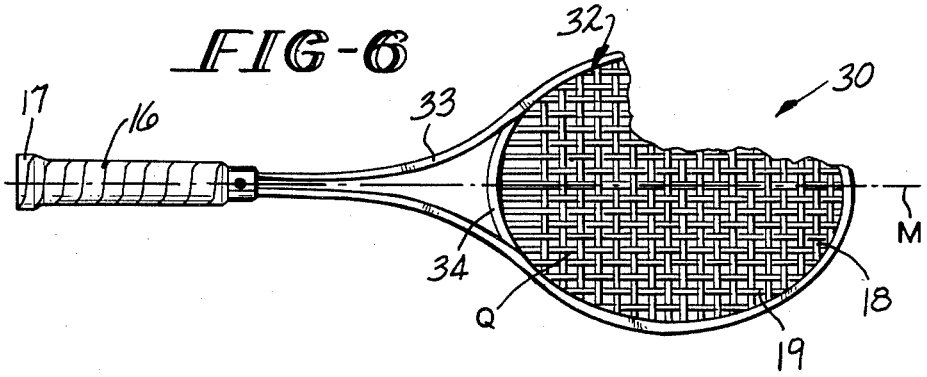
FIG-7
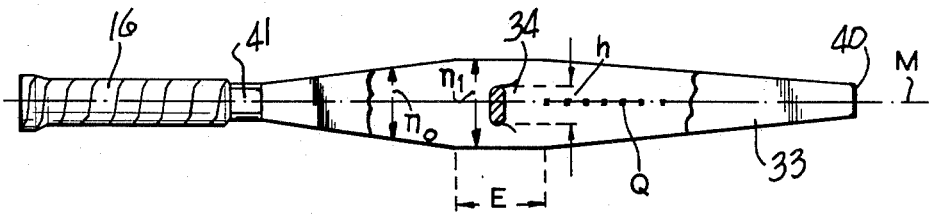
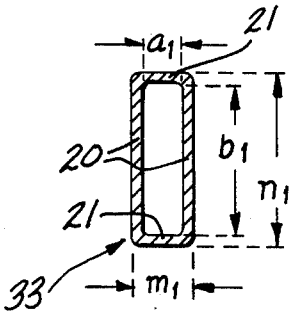
FIG-8
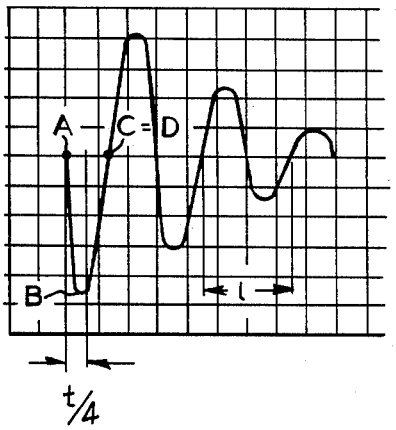
FIG-9

FIG-10
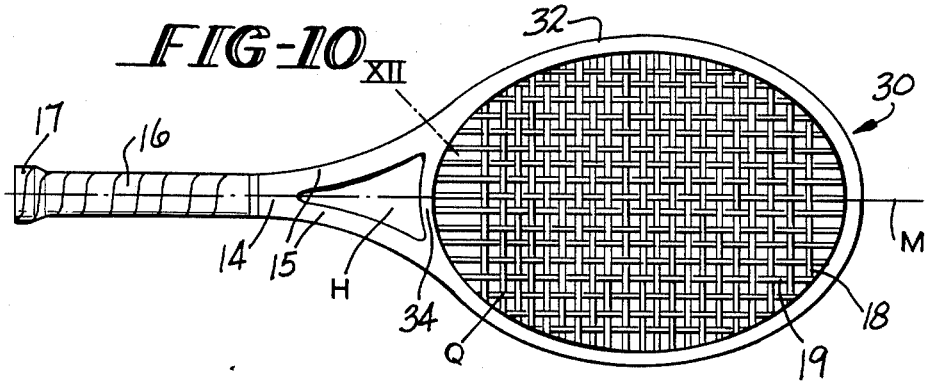
FIG-11
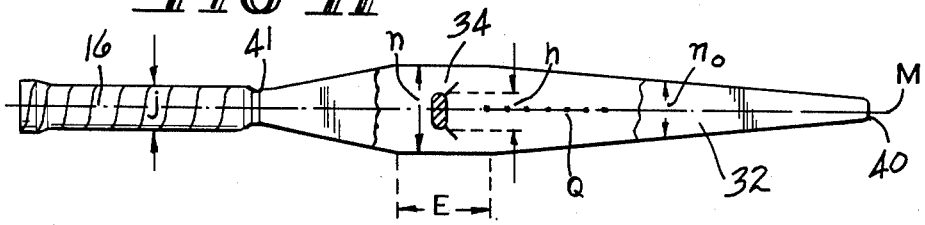
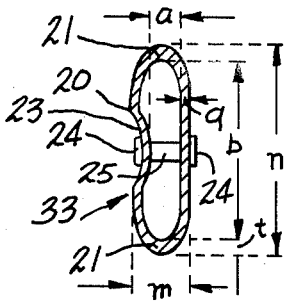
FIG-12
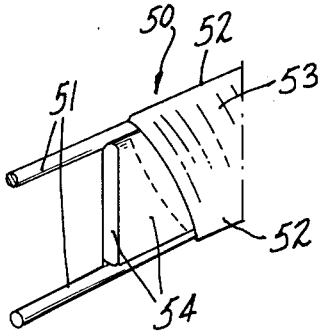
FIG-13
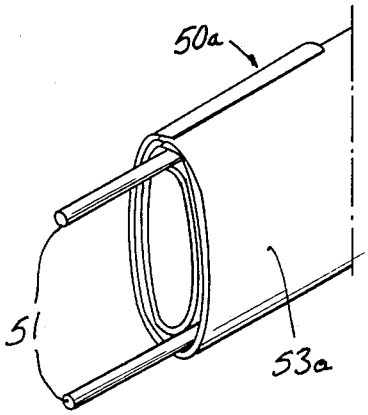
FIG-14

TENNIS RACKET

CROSS-REFERENCE TO RELATED APPLICATIONS

This application is a continuation-in-part of copending U.S. Patent Application Ser. No. 698,189, filed Feb. 4, 1985, now U.S. Pat. No. 4,664,380.

BACKGROUND OF THE INVENTION

The invention relates generally to a racket for playing a game with a ball of limited resiliency, especially a tennis racket.

A conventional racket for playing such a ball game comprises a stringing frame portion or racket head, with suitable stringing therein. Adjoining the racket head frame portion is a throat region, which in turn is connected to a handle at the end of the racket remote from the racket head frame portion, by a suitable shaft arrangement. In a conventional tennis racket of that kind, the height of the handle without any cladding or wrapping material thereon, is from 23 to 32 mm while the height of the racket head frame portion is less than the thickness of the handle. The height of the handle and the height of the racket head frame portion are measured in the direction in which a ball is struck by the racket, being therefore measured in a direction which is normal to the plane in which the stringing of the racket lies. A racket of the conventional dimensions referred to above is disclosed for example in German laid-open application (DE-OS) No 30 18 354.

Experiments have shown, that in tennis rackets of the above-indicated kind, when gripped in the region of the handle thereof, the fundamental natural frequency or inherent frequency or oscillation frequency of the racket is 25 to a maximum of 50 Hz; unstringed tennis rackets generally have slightly higher values.

When a ball strikes against or is hit by the stringing, it is known that the ball forces the racket head frame portion out of the longitudinal axis of the racket and results in the reliability of aim of the ball being adversely affected, the above-mentioned deflection of the racket head frame portion also being responsible for the direction in which the ball flies.

Due to the different values of the natural or oscillation of the tennis racket on the one hand and the "ball resonance" of about 125 Hz on the other hand, it can be shown that deviations of up to a meter from the desired line of flight of the ball occur over the entire length of for example a tennis court. The ball-striking accuracy of such known tennis rackets therefore leaves much to be desired.

SUMMARY OF THE INVENTION

An object of the present invention is to generally improve the ball-striking performance of a racket such as a tennis racket.

Another object of the present invention is to provide a racket such as a tennis racket wherein the deflection and deviation phenomena found in the prior-art rackets as referred to above are at least substantially reduced.

Yet another object of the present invention is to provide a racket such as a tennis racket whose construction and dimensions are especially adapted to increase the accuracy of striking with the racket.

These and other objects are achieved in a racket comprising a handle, a racket head frame member provided with stringing, and a shaft arrangement connecting the handle and the racket head frame member, with the shaft arrangement including a throat region adjoining the racket head frame member, wherein the resonance frequency of the stringed frame member which is secured to the racket handle is approximately adapted to the period of time for which the ball remains in contact with the stringing in use of the racket. Preferably, in accordance with the present invention, the fundamental or natural or oscillation frequency of the racket substantially coincides with the excitation frequency of the ball, and is preferably from about 70 to 200 Hz, more preferably from 100 to 140 Hz. The ball contact time is from about 2.5 to 7 ms, for half an oscillation. It is found that a racket in accordance with the invention enjoys substantially improved striking accuracy and performance.

Thus, the present invention resides in a tennis racket for use with a ball of limited resiliency having a longitudinal axis which comprises:

a handle;

a frame portion including a frame member having an annular opening, stringing on said frame member covering said annular opening, shaft members depending from the frame member and including a transition from the shaft members to the handle, a throat member extending between the shaft members and forming a base of said annular opening, said throat member and said shaft members defining a throat region, said handle being connected to the shaft members in the longitudinal axis of the racket forming a straight line of symmetry, wherein the cross-sectional height of said frame portion as measured in a direction perpendicular to the plane of the stringing is greater than the parallel thickness of said handle;

and wherein the oscillation frequency of said frame portion substantially corresponds to the excitation frequency of said ball. In the preferred embodiment the racket is a tennis racket and the ball is a standard new tennis ball.

In accordance with the principles of this invention, the racket which is the same as known rackets insofar as the racket head frame member thereof, or a frame bar member forming the racket head frame member, is of a cross-sectional width, as measured in the plane of the stringing, of between 8 and 16 mm, has a moment of inertia which is from 4 to 16 times higher than that of a tennis racket in accordance with the prior art, the cross-sectional height in which, as measured in a plane normal to the plane of the stringing, is equal to or less than the thickness of its handle as measured in the same direction.

Further in accordance with the invention is a racket having a handle which, without wrapping or cladding material thereon and disregarding the handle end cap member, is of a conventional thickness of about 23 to 32 mm, with the axis of the racket forming a straight line of symmetry, while the height of a cross-section of the frame portion, as measured in a direction normal to the plane of the stringing therein, is greater than the above-mentioned thickness of the handle. The thickness of the handle is set by the size of the human hand and therefore remains within certain constant limits, without therefore having any effect on the configuration of the racket. In accordance with a further feature of this invention, the above-indicated ratio in respect of the thickness of the handle to the height or a cross-section of the racket head frame member also applies in regard to a frame bar member from which the racket head frame member is produced and which extends beyond the racket head frame member, from the throat region thereof to the handle where it is fixedly connected thereto.

A preferred maximum height in respect of the cross-section of the racket head frame member and/or a bar member forming same has been found to be a measurement of greater than the thickness of the handle up to about 45 mm.

In accordance with the invention, the height of the cross-section of the frame portion or more particularly the racket head frame member thereof, as measured in a direction normal to the plane of the racket stringing, increases relative to the thickness of the handle either abruptly or progressively, and may decrease again from the point of maximum dimension towards the head end of the racket, that is to say, the end remote from the handle thereof, with the reduction in dimension again being either abrupt or progressive.

Thus, it has been found desirable for the racket to be of its maximum height (as measured in a direction normal to the plane of the stringing) in the throat region, and to taper both towards the handle end and towards the head end of the racket, that is to say, in both directions along the longitudinal axis of the racket; the maximum height of the racket is preferably constant over a portion which extends on both sides of the throat region of the racket.

In accordance with a further feature of the invention, the maximum height of the racket is disposed at the transition between the shaft arrangement of the racket and the handle, wherein the height of the racket or its cross-section may decrease from that transitional location or at a spacing therefrom, towards the head end of the racket. The reduction in dimension may be progressive, producing a straight-lined longitudinal contour, but it is also possible for the longitudinal contour to be of a curved or progressively varying configuration.

A consideration which is of particular significance in regard to a preferred embodiment of a racket according to the invention is the configuration of the throat region, in the form of a narrow frame portion whose height (as measured in the direction normal to the plane of the stringing) is less than the corresponding height of the bar member forming the racket head frame member.

Where reference is made hereinbefore and also hereinafter to a cross-sectional dimension, it should be borne in mind that the longitudinal axis of the racket is also an axis of symmetry, that is to say, in opposite relationship to the cross-section referred to, on the other side of the axis of symmetry of the racket, is another, corresponding cross-section. In addition, in accordance with a feature of the invention, the stringing of the racket represents or defines a plane of symmetry.

A further feature of the present invention results in an improvement of the stability of the frame portion of such a tennis racket without complicating its manufacture. This is accomplished by the tennis racket being cold-cast or thermally hardened from a fiber material with resin, wherein at least the frame portion thereof is produced from a band-like or strip-like blank, on the longitudinal edges of which each run at least one longitudinal rope or string member. The latter is preferably made of fiber material, but can also contain metal or be manufactured from it. Especially suited for this is a lattice material known under the trade name boron.

It is also within the scope of the invention to arrange the longitudinal ropes or strings between an outer and inner flexible tube or between the bearings of a multilayer lap.

In accordance with this construction, an especially stable cross-section of the tennis racket results which acts together with the increased heights of the frame portion. The tennis racket preferably has its greatest height in the heart zone and tapers both towards the handle and the head of the racket, that is in both directions of the longitudinal axis. The greatest height is preferably constant in the region running on both sides of the heart zone.

Further features, details and advantages of a racket in accordance with the principles of this invention will be apparent from the following description of preferred embodiments thereof and accompanying drawing.

BRIEF DESCRIPTION OF THE DRAWING

FIG. 1 is a partly broken-away plan view of a known tennis racket with a frame made from shaped tubing, FIG. 2 is a side view of the racket shown in FIG. 1, FIG. 3 is a view in cross-section taken along line III—III in FIG. 1, on an enlarged scale, FIG. 4 is an oscillation diagram in respect of the tennis racket shown in FIGS. 1 through 3, FIG. 5 is a diagram showing a condition of loading, FIG. 6 is a plan view of part of a preferred embodiment of a tennis racket in accordance with this invention, with its strung frame, FIG. 7 is a side view corresponding to that shown in FIG. 2, of the racket shown in FIG. 6, FIG. 8 is a view in cross-section through the frame structure of the racket according to the invention, FIG. 9 is an oscillation diagram in respect of the racket shown in FIGS. 6 through 8, FIG. 10 shows a partial plan view of a tennis racket of the present invention, FIG. 11 is a side view corresponding to that shown in FIG. 2, of the racket shown in FIG. 10, FIG. 12 is a cross-section of the frame portion along line XII of FIG. 10, FIG. 13 is a view of a blank for producing the frame portion, FIG. 14 is another blank for producing the frame portion.

DESCRIPTION OF PREFERRED EMBODIMENTS

Figure 15:
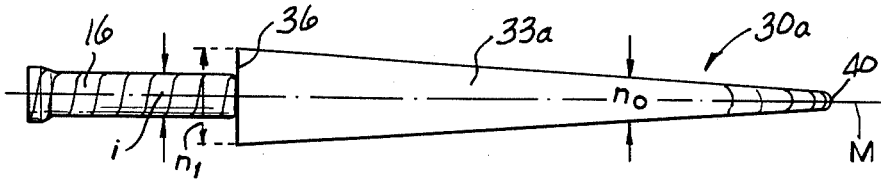
FIGS. 15 through 17 show diagrammatic side views of selected, preferred embodiments of a tennis racket according to the invention.

Referring firstly to FIGS. 1 through 3, shown therein by way of example is a tennis racket of known kind, as indicated generally by reference numeral 10. The racket 10 comprises an at least generally oval stringing frame portion 12 comprising a suitably curved bar or tube member or frame member as indicated at 13 which, on both sides of the longitudinal axis of the racket as indicated by M, terminates in arms 15 which define the shaft arrangement of the racket and which delimit a throat portion 14 of a plate-like configuration. The arms 15 are fixed in a handle 16 which is of a thickness i (as shown in FIG. 2) of from 26 to 32 mm; the thickness i is measured at the handle 16 without any wrapping or cladding leather thereon and disregarding a handle end cap member as shown at 17 in FIG. 1.

The frame portion 12 including throat portion 14 defines a stringing area as indicated by Q in FIG. 1, comprising transverse strings 18 and longitudinal strings 19 crossing the strings 18. The preferred point of impact for a tennis ball (not shown), which is sometimes referred to as the sweet spot, is denoted by S in FIG. 1.

The frame portion 12 and the frame portion 13 forming same are of generally square or rectangular cross-section as shown for example in FIG. 3, comprising side walls 20 which are disposed for example at a spacing as indicated by a of 7 mm, while transverse walls 21 thereof are disposed at a spacing b of 17 mm.

With the gauge q of the walls 20 and 21 of the frame portion being 2 mm, the external width of the frame structure as illustrated in FIG. 3 and denoted by m therein is 11 mm while the external height as indicated by n is 21 mm. The later is much less than the thickness i of the handle 16.

The cross-section area for the frame member 13, which can be calculated from the foregoing measurements, is, in square millimeters 112 $mm^{21}$.

The natural or inherent or oscillation frequency of the tennis racket 10 when in a gripped condition at its handle, as shown in FIG. 5, can be measured by suddenly removing a force indicated at P in FIG. 5, which acts on the racket at the longitudinal axis M thereof.

If the natural frequency is plotted on a tape moving at a speed of 3000 mm/s, that gives:

$$f_o = 3000/1 \text{ (Hz)}$$

wherein l is the length of oscillation in mm as read off from the tape.

The contact time as between a tennis racket 10 and the ball was established by a large number of tests, inter alia by means of high speed photography, as being from 2 to a maximum of 7 ms, being therefore on average around 4 ms, which gives for a complete oscillation t=8 ms, or 125 Hz.

FIG. 4 shows an oscillation curve in the longitudinal direction in respect of a conventional tennis racket 10 as shown in FIGS. 1 through 3. At point A, a ball strikes the meshing of the stringing Q and forces the frame portion 12 to follow the ball frequency. Dynamic inertia forces of the frame portion 12 seek to oppose such movement. When point B is reached, the ball reverses its direction of movement and leaves the stringing Q, which follows the ball, approximately at point C. The tennis racket 10 continues to oscillate at its natural frequency and is only at point D when the ball comes away from the stringing Q at point C (t=8 ms, $t/4$=2 ms).

The different values in respect of the natural or oscillation frequency of the tennis racket 10, of from 25 to 50 Hz on the one hand, and the excitation frequency of the ball of about 125 Hz on the other hand, result, over the full length of a court, in significant deviations of the ball from the desired line of flight thereof; as mentioned above, such deviations may be up to around a meter.

Referring now to FIGS. 6 through 8, shown therein is a tennis racket in accordance with the principles of this invention, as denoted generally by reference numeral 30. The tennis racket 30 has a resonance frequency which at least tends to remedy the above-mentioned defect in the known racket. The cross-section of the shaft member 33 forming the frame of the racket, as shown in FIG. 8, is of the following dimensions:

internal width $a_1$: 8 mm
external width $m_1$: 10 mm
internal height $b_1$: 32.2 mm
external height $n_1$: 37 mm.

Those dimensions were found as the result of a calculation which confirms coincidence as between the natural frequency of the tennis racket 30 and the "ball resonance", that is to say, coincidence as between excitation frequency and natural frequency.

The cross-sectional area which can be calculated is in this case also calculated to 112 $mm^2$ and is therefore equal to the cross-sectional area of the tennis racket 10.

FIG. 7 reproduces a frame configuration which takes account of the foregoing considerations. In FIG. 7, a region E has the height $n_1$ of the frame structure projecting, on both sides of a throat member 34 which extends across the throat portion of the racket, as can be best seen from FIG. 6. From the region E, the height $n_0$ progressively decreases towards the head end 40 of the racket frame on the one hand and towards the handle attachment point as indicated at 41. The throat member 34 which is shown in cross-section in FIG. 7 replaces the throat plate member 14 which was described hereinbefore with reference for example to FIG. 1, and is of a smaller mean height as indicated at h in FIG. 7, than the frame bar member 33.

The oscillation performance of the tennis racket 30 according to the invention, in the longitudinal direction thereof, is shown in FIG. 9. The excitation frequency of the ball is now the same as the natural or oscillation frequency of the racket. When the ball leaves the stringing Q, the racket 30 is at point C or has reached the direct vicinity thereof, and, besides receiving additional acceleration, from the frame portion 32 of the tennis racket 30, the ball also receives a precise trajectory which is no longer falsified by the degree of deflection as indicated by Z in FIG. 4. In the case of balls which impinge on the tennis racket 30 or the stringing Q thereof inaccurately, that is to say, off the longitudinal axis M thereof, there is a torsional or twisting oscillation about the longitudinal axis m, which is superimposed on the longitudinal oscillation. If that oscillation is also adjusted to a preferred value of 125 Hz by adapting the throat member 34 shown in FIG. 7, the entire tennis racket 30, upon making contact with the ball, oscillates only with a sinusoidal pattern at one frequency and also compensates for deviations in the line of striking of the ball, due to the twisting effect, by virtue of a return oscillation in good time.

The handle 16 of the tennis racket 30 as shown in FIGS. 6 through 8 and the handles of the other embodiments of the present invention as described herein which, as stated above, is from 23 to 32 mm, while in comparison with that thickness i, the adjoining frame portion over at least a portion thereof, is of a greater external height as indicated by $n_1$, in all cases.

FIG. 10 shows frame portion 30 with a racket axis M forming an axis of symmetry having frame member 32 made of a curved profile bar as well as of a frame crosspiece of throat member 34 crossing the longitudinal axis M of the racket, the crosspiece completing the curved profile bar to form an oval; starting from the frame member 32 two profile bar ends 15 form the shaft members laterally limiting an open heart zone H as lateral sides of an approximate triangle (FIG. 10), the third side of which represents the frame crosspiece or throat member 34. Shaft members 15 verge into a neck of the racket 14 to which adjoins a handle 16 having a thickness J of 26 to 32 mm. The thickness J is measured at the handle 16 without covering leather and without considering the handle cap 17.

The frame member 32 and the throat member 34 determine a stringing area Q consisting of transverse strings 18 and longitudinal strings 19.

According to FIG. 12 the frame member 32 respectively has an elongated cross-section, the side walls 20 of which run at a distance a of approximately 7 mm and its narrow lateral walls 21 at a distance b of approximately 34 mm.

Given a wall thickness q of the side walls 20 of approximately 1.5 mm or a wall thickness t of the lateral walls 21 of approximately 10 mm, an outer breadth m of approximately 10 mm and an outer height n of approximately 42 mm result. The latter is thus considerably higher than the thickness i of the handle 16. In FIG. 12 a groove-like indentation 23 is provided at the outside of the frame member in which a collar 24 of a conduit crosspiece 25 in the form of a tubular rivet tests as a string passage. The region E having the above-mentioned profile height n extends on both sides of the throat member 34. From the region E the profile height $n_0$ constantly diminishes both towards the racket head 40 and the handle connection 41. The throat member 34 shown in FIG. 11 has a considerably smaller mean profile height h than the frame member 32.

The oscillation behavior of the tennis racket 30 of FIG. 10 according to the invention in the longitudinal direction can also be taken from FIG. 9. Its proper frequency corresponds with the excitation frequency of the tennis ball not shown of about 125 cps when the tennis ball gets off the stringing Q the tennis racket, reaches the point C or its direct neighborhood and receives, apart from an additional acceleration from the frame member 32, an exact flight path which is no longer distracted by an excursion. In the case of balls not hitting exactly in the so-called "sweet spot", a torsional oscillation develops around the longitudinal axis M which is superimposed on the longitudinal oscillation.

If also this ocillation is put to preferably 125 cps by tuning-in the throat member 34, the entire tennis racket 30, when hit by the ball, only oscillates sinusoidally in one frequency and compensates also torsion-conditioned hit deviations by swinging back.

At least the frame portion 30 of the tennis racket of the present invention is cold cast or thermally hardened from a fiber material. Racket 30 is made of a strip-like blank 50 having longitudinal string members 51 made of fiber material, metal or ceramic. String members 51 run as shown in FIG. 13 in strip-like blank 50 for the frame portion having narrow sides and longitudinal edges 52, respectively, within a flexible tube 53 preferably made of fiber material and with an interior member or flexible tube 54 preferably made of foil. In the embodiment of FIG. 14, blank **50*a* includes a multilayer lap member 53*a* preferably made of fiber material and resin, with longitudinal string members 51 laid between lap layers of the member 53*a***.

In FIG. 15, the increased external height $n_1$ occurs at the transitional portion 36, which is an abrupt transition, between the handle 16 and the frame member **33*a* which then steadily tapers to the head end 40** of the racket head frame portion, as indicated by the height $n_0$.

Figure 16:
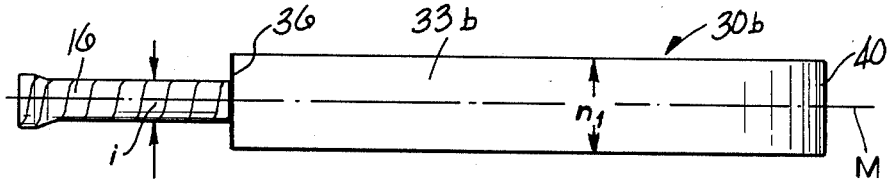
Figure 17:
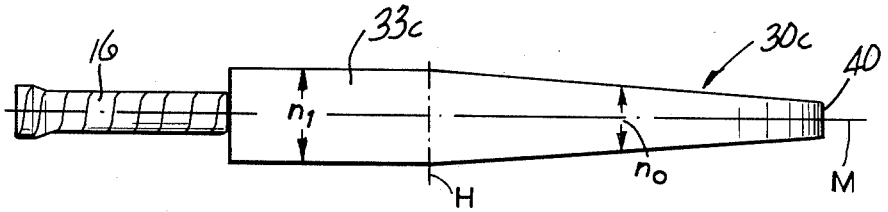
Figure 17A:
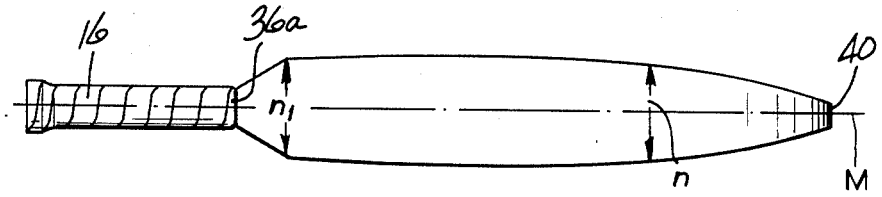
FIG. 17*a* shows a modified embodiment of the FIG. 12 construction.

The frame member **33*b* shown in FIG. 16 is overall of that maximum height $n_1$, while the maximum height $n_1$ of the frame member 33*c* shown in FIG. 17 terminates approximately at the throat region as indicated by the dash-dotted line H, and then decreases, as indicated by height $n_0$, to the head end 40** of the racket head frame portion.

The embodiments of the racket in accordance with this invention, as shown for example in FIGS. 15 through 17 have a frame defined by straight lines extending from the point of maximum height as indicated by $n_1$, so that they are either of a straight-sided configuration as shown in FIG. 16 or have a progressive reduction in the variable dimension $n_0$ as shown for example in FIGS. 15 and 17. Instead of that straight-lined configuration however, the corresponding cross-sectional configurations could also be curved as shown by way of example in FIG. **17*a* where the frame progressively decreases towards the racket head end 40**, but with a curved outline as is clearly apparent.

Various other modifications and alterations may be made in the above-described embodiments of this invention without thereby departing from the spirit and scope thereof.

What is claimed is:

1. A tennis racket, for use with a ball of limited resiliency, having a longitudinal axis which comprises:

a handle;

a frame portion including a frame member having an annular opening, stringing on said frame member covering said annular opening, shaft members depending from the frame member and including a transition from the shaft members to the handle, a throat member extending between the shaft members and forming a base of said annular opening, said throat member and said shaft members defining a throat region, said handle being connected to the shaft members in the longitudinal axis of the racket forming a straight line of symmetry, wherein the cross-sectional height of said frame portion as measured in a direction perpendicular to the plane of the stringing is greater than the parallel thickness of said handle;

and wherein the oscillation frequency of said frame portion substantially corresponds to the excitation frequency of a standard new tennis ball.

2. A racket according to claim 1 wherein the frame portion thereof is produced from a strip-like blank having longitudinal edges, wherein a string member runs along each of said longitudinal edges.

3. A racket according to claim 2 wherein said frame portion comprises a fiber material with resin.

4. A racket according to claim 2 wherein said strip-like blank has narrow sides and longitudinal edges within a flexible tube and including an interior member.

5. A racket according to claim 2 wherein said strip-like blank includes a multilayer lap member, wherein said string members run between lap layers.

6. A racket according to claim 2 wherein said string member is selected from the group consisting of fiber, metal and ceramic.

7. A racket according to claim 1 wherein said frame member has an elongated generally oval cross-section, with at least one longitudinal wall thereof forming a groove-like indentation.

8. A racket according to claim 7 including a collar and a conduit crosspiece seated in said groove-like indentation.

9. A racket according to claim 1 wherein it is of its maximum height as measured in a direction normal to the plane of said stringing in said throat region and tapers both towards said handle and towards the end of said frame portion which is remote from said handle.

10. A racket according to claim 9 wherein said taper is progressive.

11. A racket according to claim 9 including a region of maximum height extending on both sides of said throat region.

12. A racket according to claim 1 having an open throat region which is limited by sections of the shaft member meeting towards the handle and by a throat member connecting said sections on the frame portion, wherein the height of the throat member is smaller than the height of the shaft member.

13. A racket according to claim 12 wherein the cross-section of the greatest height of the shaft member are provided on both sides of the throat member.

* * * * *